US007431363B1

(12) United States Patent
Loney

(10) Patent No.: US 7,431,363 B1
(45) Date of Patent: Oct. 7, 2008

(54) AUTOMATIC RELEASE HOOK

(76) Inventor: Josh D. Loney, 3515 Heutte Dr., Norfolk, VA (US) 23518

( * ) Notice: Subject to any disclaimer, the term of this patent is extended or adjusted under 35 U.S.C. 154(b) by 275 days.

(21) Appl. No.: 10/945,676

(22) Filed: Sep. 21, 2004

(51) Int. Cl.
*B66C 1/34* (2006.01)

(52) U.S. Cl. ..... 294/82.33; 294/82.1

(58) Field of Classification Search ..... 294/82.1, 294/82.2, 82.27, 82.31, 82.33; 24/600.1
See application file for complete search history.

(56) References Cited

U.S. PATENT DOCUMENTS

| | | | | |
|---|---|---|---|---|
| 32,408 | A | | 5/1801 | Brooks |
| 33,413 | A | | 10/1861 | Birdsell |
| 71,779 | A | | 12/1867 | Neveil |
| 116,511 | A | | 6/1871 | Thorne |
| 267,089 | A | | 11/1882 | Liermann |
| 393,952 | A | | 12/1888 | Wood |
| 403,103 | A | | 5/1889 | Harkinson |
| 408,620 | A | | 8/1889 | Hitchcock |
| 462,721 | A | | 11/1891 | Monroe |
| 517,945 | A | | 4/1894 | Briggs |
| 555,462 | A | | 2/1896 | Morrow |
| 706,246 | A | | 8/1902 | Marr |
| 827,795 | A | | 8/1906 | Foucher |
| 845,693 | A | | 2/1907 | Thompson |
| 1,184,190 | A | | 5/1916 | McIntyre |
| 1,215,046 | A | | 2/1917 | Montgomery |
| 2,095,843 | A | | 10/1937 | Sullivan |
| 2,337,580 | A | * | 12/1943 | Webster ..... 294/164 |
| 2,419,650 | A | | 4/1947 | MacCluney |
| 3,998,487 | A | | 12/1976 | Biondo |
| 5,901,990 | A | * | 5/1999 | McMillan ..... 294/82.33 |

* cited by examiner

*Primary Examiner*—Saul J. Rodriguez
*Assistant Examiner*—Paul T Chin
(74) *Attorney, Agent, or Firm*—Bowman Green Hampton & Kelly, PLLC

(57) ABSTRACT

An automatic release hook comprises at least some of a body, a hook, and a counter-weighted locking arm. During operation of an illustrative, non-limiting embodiment of this invention, the automatic release hook does not need to be manually manipulated to release a suspended, attached, or coupled item. When a load is suspended or hung from the hook, the counter-weighted locking arm maintains the release hook in a locked or secured position because of the weight of the load. When the load is placed on a surface and the weight of the load is no longer carried by the automatic release hook, the counter-weighted locking arm pivots and releases the release hook, which, in turn, releases the load.

20 Claims, 8 Drawing Sheets

AUTOMATIC RELEASE HOOK

BACKGROUND OF THE INVENTION

1. Field of the Invention

This invention relates generally to release hooks. In particular, the present invention relates to an automatic release hook.

2. Description of Related Art

Generally, release hooks, such as, for example, pelican hooks, are used to temporarily suspend or secure heavy items or articles by chain or rope, for lifting and moving. These known release hooks generally include a hook lock with a manual release mechanism. The manual release mechanism must typically be pulled or manually manipulated in order for the hook lock to be released and the suspended item to be released from the hook.

SUMMARY OF THE INVENTION

The present invention relates generally to release hooks. More specifically, the present invention relates to an automatic release hook.

Unfortunately, known release hooks must be manually manipulated in order for an item secured by the release hook to be released.

In an illustrative, non-limiting embodiment of this invention, the automatic release hook comprises at least some of a body, a hook, and a counter-weighted locking arm.

During operation of an illustrative, non-limiting embodiment of this invention, the automatic release hook does not need to be manually manipulated to release a suspended, attached, or coupled item. When a load is suspended or hung from the hook, the counter-weighted locking arm maintains the release hook in a locked or secured position because of the weight of the load. When the load is placed on a surface and the weight of the load is no longer carried by the automatic release hook, the counter-weighted locking arm pivots and releases the release hook, which, in turn, releases the load.

Accordingly, this invention provides an automatic release hook, which may be used to suspend items or articles by chain, rope, cable, wire, hook, or the like, for lifting and moving.

This invention separately provides an automatic release hook, which does not require manual manipulation in order for the item secured by the release hook to be released.

This invention separately provides an automatic release hook, which allows a suspended load to be automatically released from the automatic release hook when the load is placed on a surface and the weight of the load is no longer carried by the automatic release hook.

This invention separately provides an automatic release hook, with improved efficiency.

This invention separately provides an automatic release hook, which requires reduced maintenance.

These and other features and advantages of this invention are described in or are apparent from the following detailed description of the exemplary embodiments.

BRIEF DESCRIPTION OF THE DRAWINGS

The exemplary embodiments of this invention will be described in detail, with reference to the following figures, wherein like reference numerals refer to like parts throughout the several views, and wherein.

DETAILED DESCRIPTION OF AN EXEMPLARY EMBODIMENT

For simplicity and clarification, the design factors and operating principles of the automatic release hook of this invention are explained with reference to various exemplary embodiments of an automatic release hook according to this invention. The basic explanation of the design factors and operating principles of the automatic release hook is applicable for the understanding, design, and operation of the automatic release hook of this invention.

Figure 1:
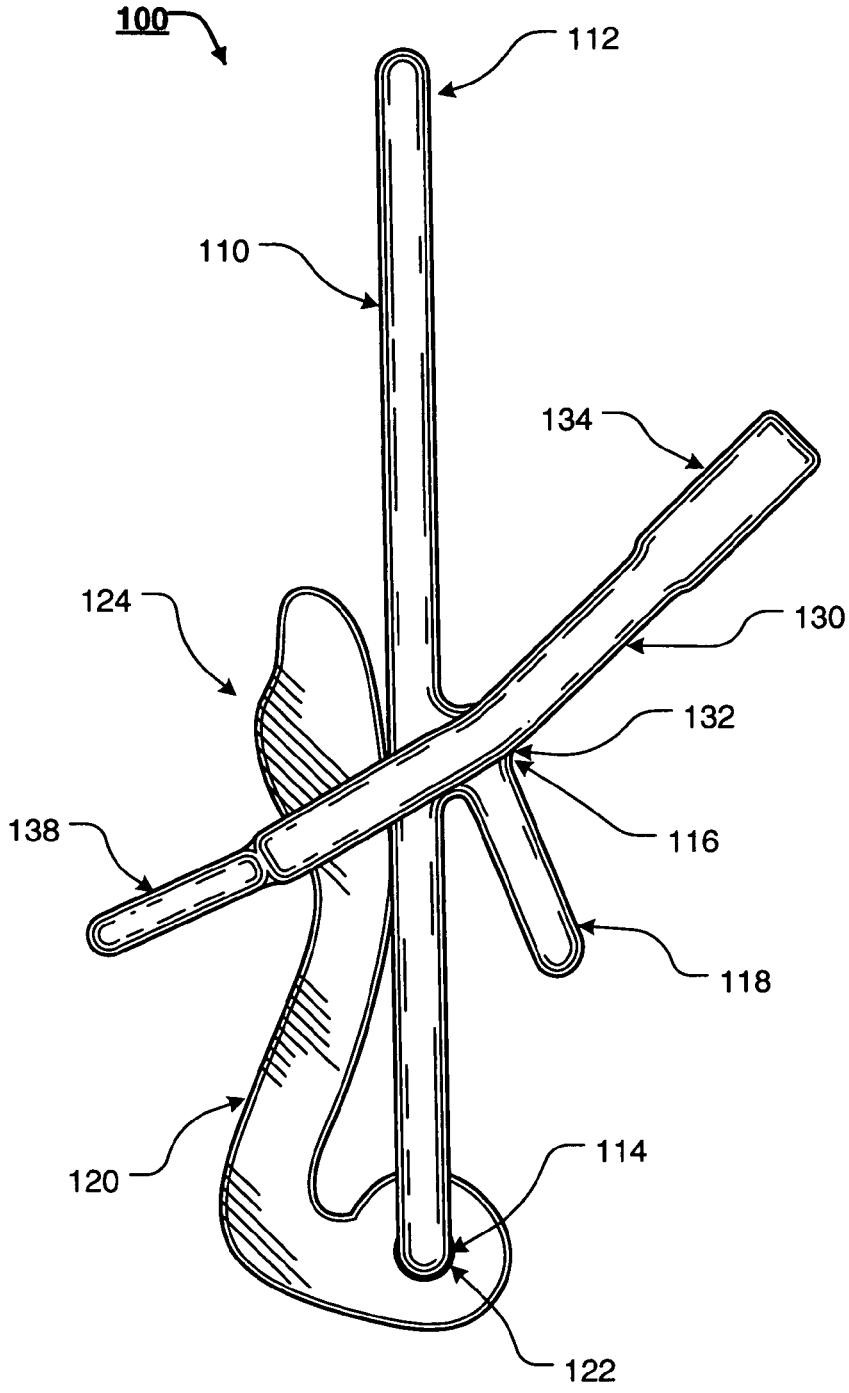
FIG. 1 shows a side view of a first exemplary embodiment of an automatic release hook in a closed position according to this invention.
Figure 2:
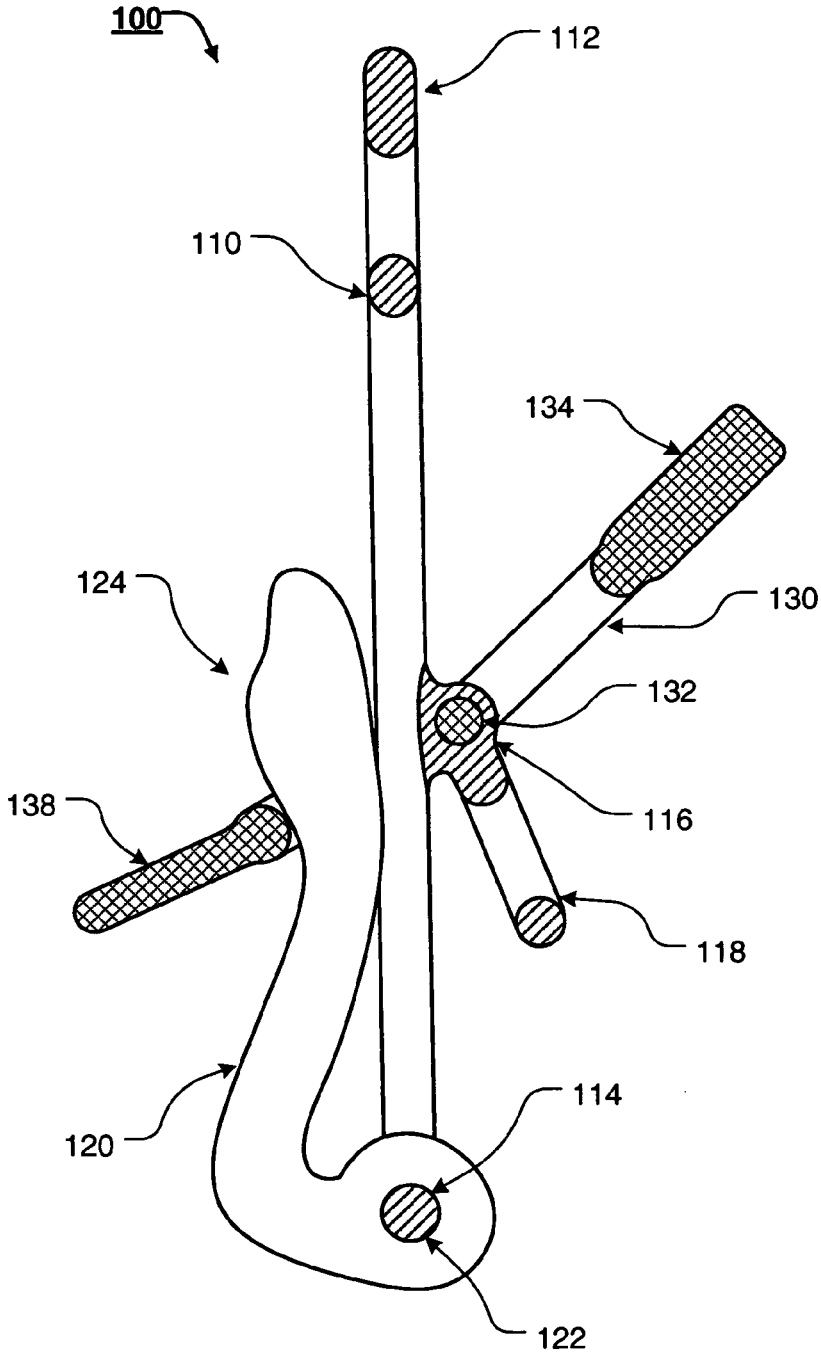
FIG. 2 shows a cross-sectional view of a first exemplary embodiment of an automatic release hook in a closed position according to this invention.
Figure 3:
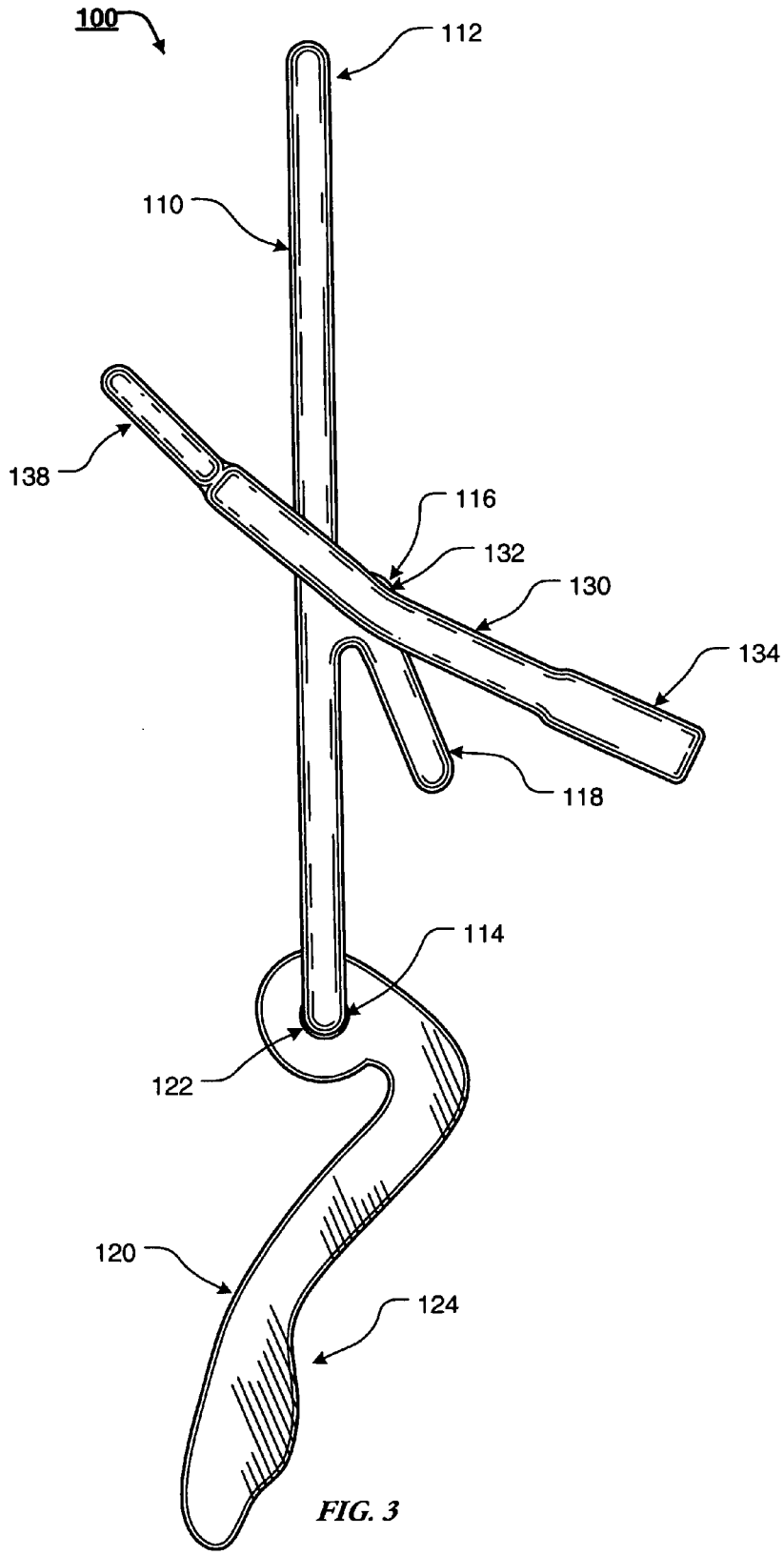
FIG. 3 shows a side view of a first exemplary embodiment of an automatic release hook in a open position according to this invention.
Figure 4:
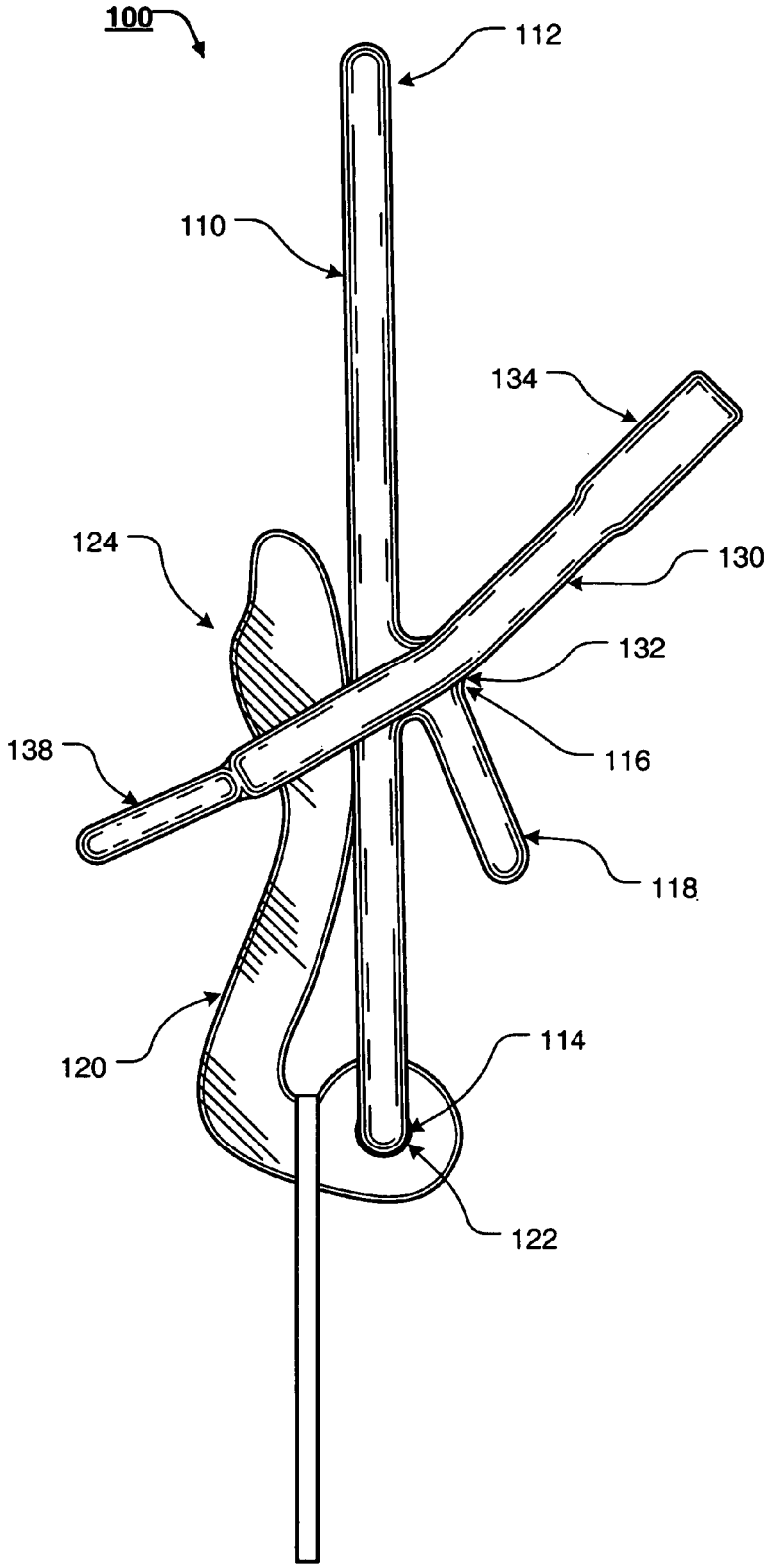
FIG. 4 shows a side view of a first exemplary embodiment of an automatic release hook holding a load (not shown) in a closed position according to a first exemplary embodiment of this invention.
Figure 5:
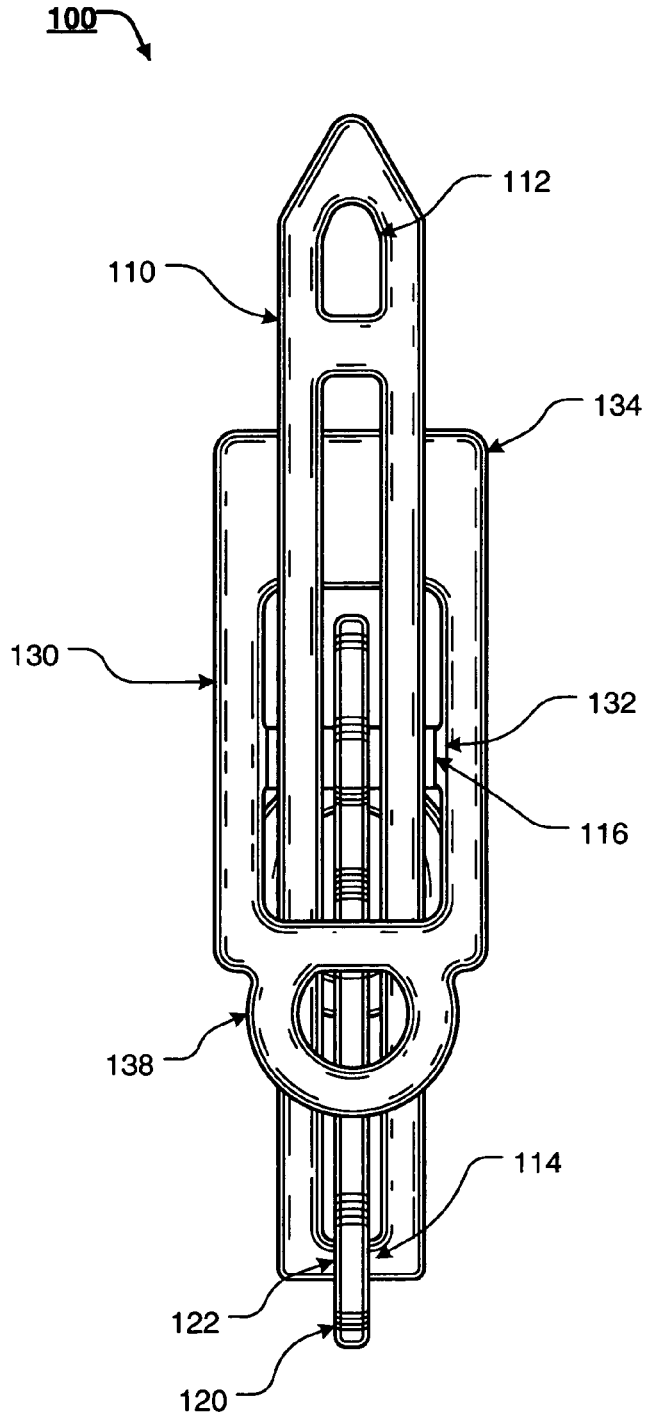
FIG. 5 shows a front view of a first exemplary embodiment of an automatic release hook in a closed position according to this invention.
Figure 6:
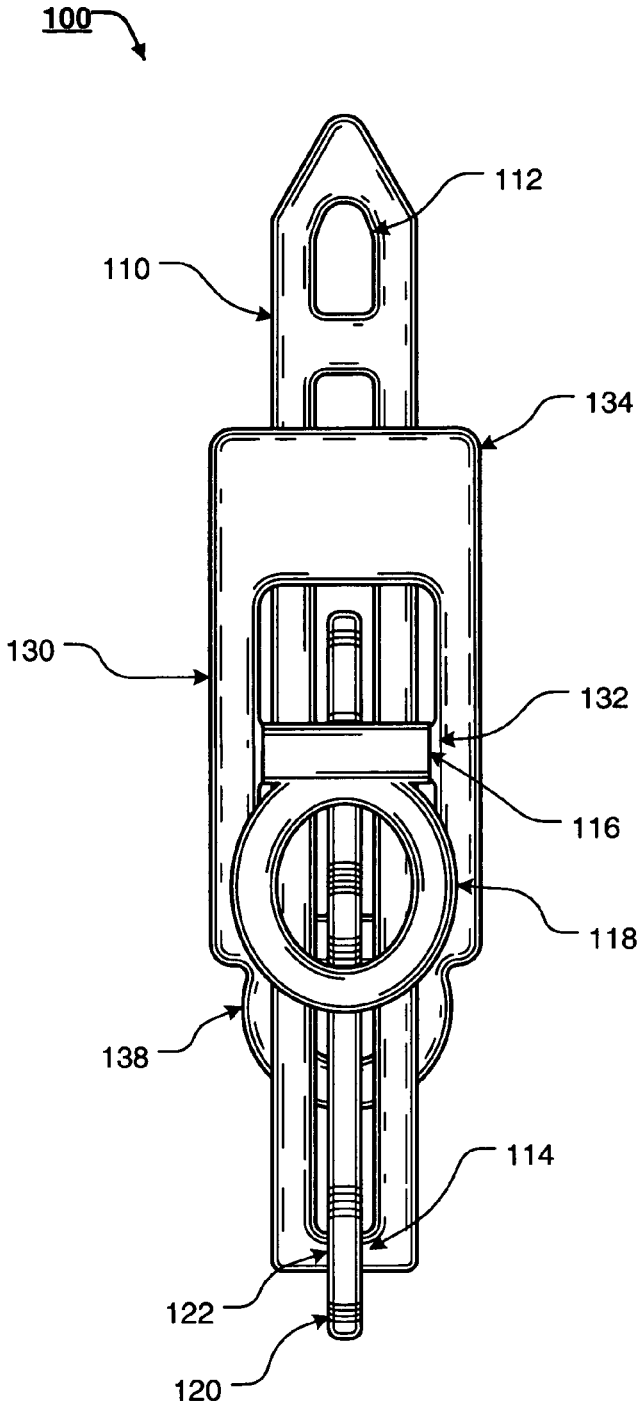
FIG. 6 shows a rear view of a first exemplary embodiment of an automatic release hook in a closed position according to this invention.

FIG. 1 shows a first perspective view of a first exemplary embodiment of an automatic release hook 100 according to this invention, while FIG. 2 shows a cross-sectional view of a first exemplary embodiment of an automatic release hook 100 in a closed position according to this invention. FIG. 3 shows a side view of the first exemplary embodiment of an automatic release hook 100 in an open position. FIG. 4 shows a side view of a first exemplary embodiment of an automatic release hook holding a load (not shown) in a closed position according to a first exemplary embodiment of this invention. FIGS. 4 and 5 illustrate the invention more clearly by showing a front view and a rear view, respectively, of a first exemplary embodiment of an automatic release hook 100 in a closed position.

In an exemplary, non-limiting embodiment of this invention, the automatic release hook 100 comprises at least some of a body 110, a hook 120, and a locking arm 130. In various exemplary embodiments, each of these components and their associated elements is formed substantially of a type or alloy of steel, such that the automatic release hook 100 may be capable of suspending relatively heavy loads. However, it should be appreciated that the automatic release hook 100 should be formed of a material such that the automatic release hook 100 is durable enough to withstand the wear and tear associated with the desired use of the automatic release hook 100. The particular material used to form the components of the automatic release hook 100 is a design choice based on the desired strength, durability, appearance, wearability, and/or functionality of the automatic release hook 100.

As shown in FIGS. 1-6, the body 110 is generally rectangular. The body 110 includes a primary body attachment means 112 formed at or proximate a first or distal end of the body 110, such that the body 110 may be suspended, via the primary body attachment means 112, in any known or later developed manner, such as, for example, by a chain, rope, cable, wire, hook, or the like, via the primary body attachment means 112. In various exemplary embodiments, the primary body attachment means 112 may be formed integral to and comprise a portion of the body 110. Alternatively, as illustrated in FIG. 8, the primary body attachment means 112 may comprise a hook, loop, or other elements attached or coupled to the body 110.

Figure 8:
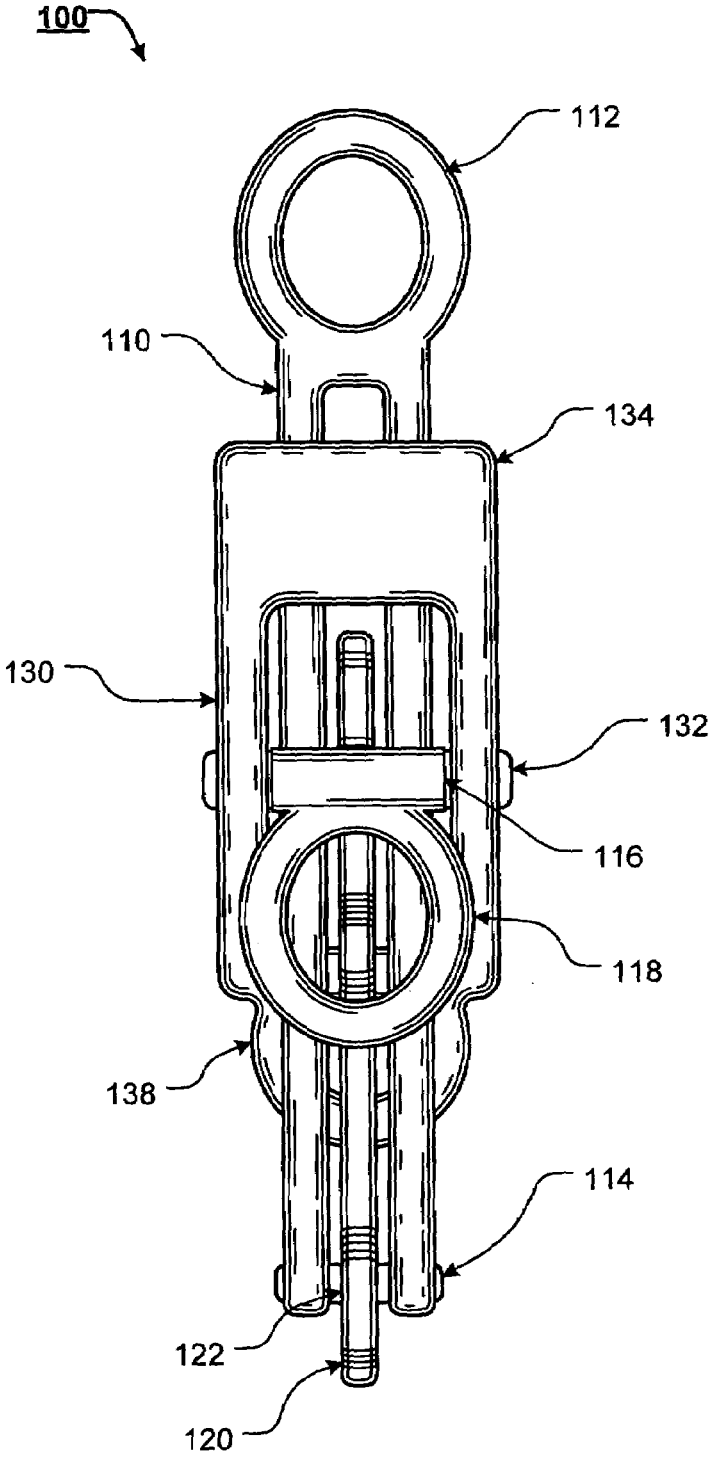
FIG. 8 shows a rear view of an alternate exemplary embodiment of an automatic release hook in a closed position according to this invention.

As illustrated in FIG. 8, a hook pivot pin 114 is formed at or proximate a second end of the body 110, such that the hook 120 may be pivotally attached or coupled to the body 110, via the hook pivot pin 114 and the hook aperture 122. In various exemplary embodiments, as shown in FIGS. 1-6, the hook pivot pin 114 may be formed integral to and comprise a portion of the body 110.

Alternatively, the body 110 may form a generally inverted "U" shape, and the hook pivot pin 114 may comprise a pin means comprising a separate pin or other element that may be attached or coupled to the body 110, such as, for example, by fitment into a hole or other aperture (not shown) in the body 110, to allow the hook 120 to be pivotally attached or coupled to the body 110, via the hook aperture 122.

As shown in FIGS. 1-6, a locking arm pivot pin aperture 116 is formed on the body 110 between the first and the second end of the body 110, such that the locking arm 130 may be pivotally attached or coupled to the body 110, via a locking arm pivot pin 132. In various exemplary embodiments, the locking arm pivot pin aperture 116 may be formed integral to and comprise a portion of the body 110. Alternatively, the locking arm pivot pin aperture 116 may comprise a collar means comprising a separate collar, a tube, corresponding holes, or some other element that may be formed in or attached or coupled to the body 110, to allow the locking arm 130 to be pivotally attached or coupled to the body 110.

As also shown in FIGS. 1-6, the body 110 includes an optional secondary load attachment means 118, such that a load may be suspended via the hook 120 and the secondary load attachment means 118. In various exemplary embodiments, the secondary load attachment means 118, if included, may be formed at or proximate the locking arm pivot pin aperture 116. In various alternative exemplary embodiments, the secondary load attachment means 118 may be formed integral to and comprise a portion of the body 110. Alternatively, the secondary load attachment means 118 may comprise a hook, loop, or other elements attached or coupled to the body 110.

The hook 120 comprises at least some of a hook aperture 122 and a locking portion 124. The hook aperture 122 is formed in the hook 120 such that the hook 120 may be pivotally attached or coupled to the body 110, via the hook pivot pin 114. The locking portion (indicated generally as 124) of the hook 120 is formed such that the hook 120 may be maintained in a closed position by the locking arm 130 when an appropriate load is suspended by a chain, rope, cable, wire, hook, or the like, from the automatic release hook 100, and more specifically, the hook 120. The locking portion 124 is also formed such that the hook 120 may be released by the locking arm 130 when the suspended load is placed on a surface and the weight of the load is no longer carried by the automatic release hook 100.

The hook 120 comprises sufficient weight, such that when the locking arm 130 releases the hook 120, the hook 120 will pivot to the open position. In various exemplary embodiments, the locking portion 124 includes sufficient weight such that when the locking arm 130 releases the hook 120, the hook 120 will pivot to the open position.

The locking arm 130 is generally rectangular and includes a locking arm pivot pin 132 formed between a first and a second end of the locking arm 130, such that the locking arm 130 may be pivotally attached or coupled to the body 110, via the locking arm pivot pin aperture 116. In various exemplary embodiments, the locking arm pivot pin 132 may be formed integral to and comprise a portion of the locking arm 130. Alternatively, the locking arm pivot pin 132 may comprise a pin means comprising a separate pin or other element that may be attached or coupled to the locking arm 130, such as, for example, by fitment into a hole or other aperture (not shown) in the locking arm 130, to allow the locking arm 130 to be pivotally attached or coupled to the body 110.

The locking arm 130 also includes a counterweight 134 formed or coupled at or proximate a first end of the locking arm 130. The counterweight 134 is of a sufficient weight and is formed or coupled to the locking arm 130 such that the locking arm 130 is maintained or biased in an open position, as illustrated in FIG. 3.

Thus, the locking arm 130 is able to pivot between a first, closed position (as illustrated in FIG. 1) and a second, opened position (as illustrated in FIG. 2). It should be appreciated that when the hook 120 is in the closed position and a load is suspended by a chain, rope, cable, wire, hook, or the like, by the hook 120, the locking portion 124 may be engaged by the locking arm 130 such that the locking arm 130 is maintained in the closed position by the locking portion 124 of the hook 120.

When the weight of the suspended load is no longer carried by hook 120, such as, for example, when the load is placed on a surface, the locking arm 130 pivots to the biased, or open, position and releases the locking portion 124 of the hook 120, which, in turn, releases the load.

In various exemplary embodiments, the locking arm 130 may also include an optional locking arm attachment means 138, such that the locking arm 130 may be secured in place or manually released. In various exemplary embodiments, the locking arm attachment means 138, if included, may be formed at or proximate a second end of the locking arm 130. In various alternative exemplary embodiments, the locking arm attachment means 138 may be formed integral to and comprise a portion of the locking arm 130. Alternatively, the locking arm attachment means 138 may comprise a hook, loop, or other elements attached or coupled to the locking arm 130.

Figure 7:
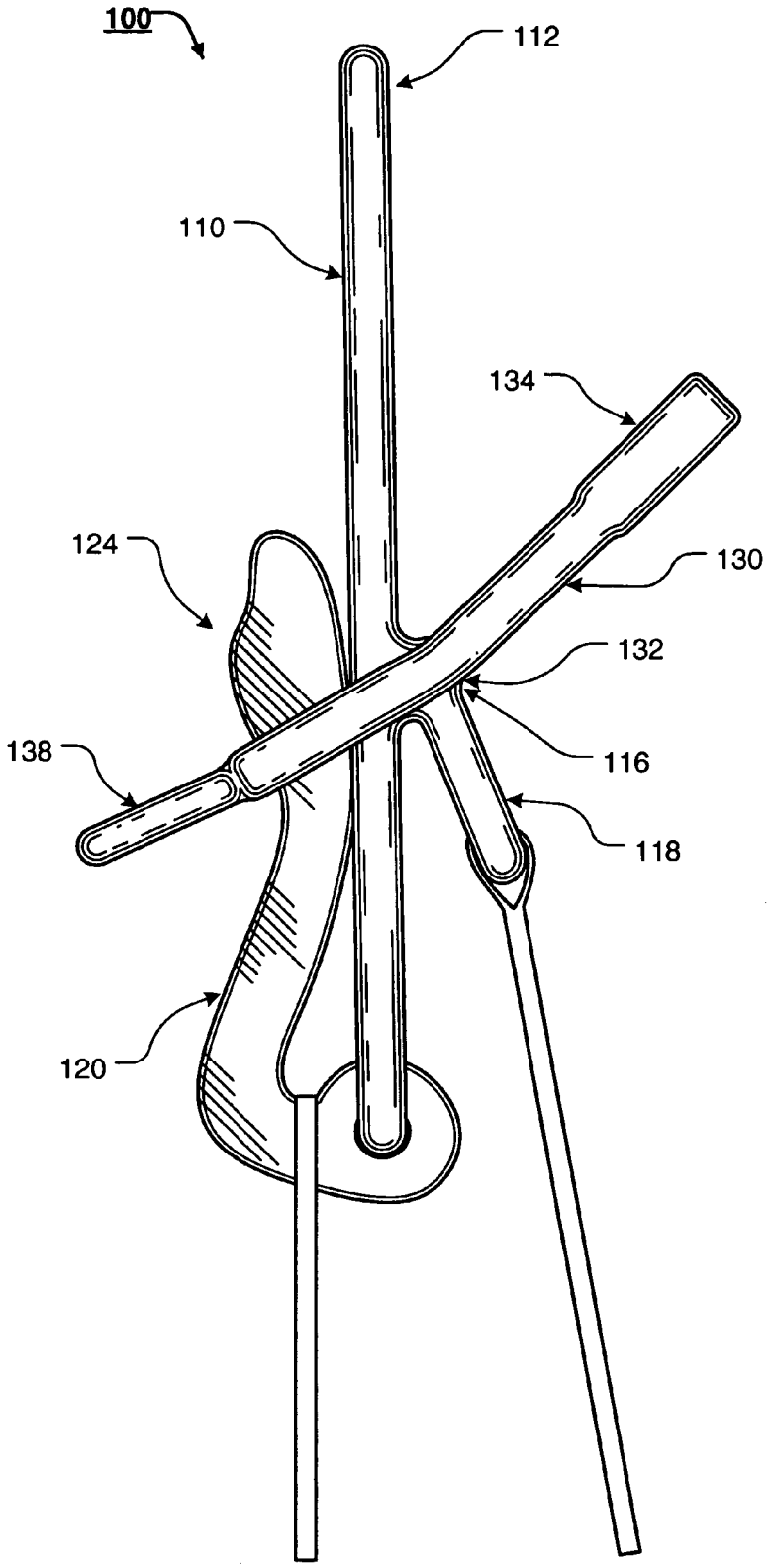
FIG. 7 shows a side view of a second exemplary embodiment of an automatic release hook holding a load (not shown) in a closed position according to a second exemplary embodiment of this invention.

FIG. 7 shows a side view of a second exemplary embodiment of an automatic release hook holding a load (not shown) in a closed position according to a second exemplary embodiment of this invention. As also shown in FIG. 7, a load is suspended by a chain, rope, cable, wire, hook, or the like, via the hook 120 and the secondary load attachment means 118.

It should be appreciated that when the weight of the suspended load is no longer carried by the hook 120 and the secondary load attachment means 118, such as, for example, when the load is placed on a surface, the locking arm 130 pivots to the biased, or open, position and releases the locking portion 124 of the hook 120, which, in turn, releases the portion of the load suspended by the hook 120. When the portion of the load suspended by the hook 120 is released, and the end of the chain, rope, cable, wire, hook, or the like, that was attached to the hook 120 is permitted to disengage from the load, while the end of the chain, rope, cable, wire, hook, or the like, attached to the secondary load attachment means 118 remains attached to the secondary load attachment means 118.

While this invention has been described in conjunction with the exemplary embodiments outlined above, it is evident that many alternatives, modifications, and variations will be apparent to those skilled in the art. Such adaptations and modifications should and are intended to be comprehended within the meaning and range of equivalents of the disclosed exemplary embodiments. It is to be understood that the phraseology of terminology employed herein is for the purpose of description and not of limitation. Accordingly, the foregoing description of the exemplary embodiments of the invention, as set forth above, are intended to be illustrative, not limiting. Various changes, modifications, and/or adaptations may be made without departing from the spirit and scope of this invention.

What is claimed is:

1. An automatic release hook comprising:

a body;

a hook; and a locking arm;

wherein the body includes a first end and a second end, wherein the body includes a primary body attachment means formed proximate the first end, such that the body may be suspended, via the primary body attachment means, wherein the body includes a hook pivot pin means proximate the second end of the body, wherein the hook pivot pin means is formed such that a hook may be pivotally coupled to the body, via the hook pivot pin, and wherein the body includes a locking arm pivot pin aperture formed between the first end and the second end, wherein the locking arm pivot pin aperture is formed such that a locking arm may be pivotally coupled to the body, via a locking arm pivot pin;

wherein the hook includes a hook aperture formed in the hook such that the hook may be pivotally coupled to the body, via the hook pivot pin, and wherein the hook includes a locking portion formed such that the hook may be maintained in a closed position by the locking arm when the weight of a load is suspended by the hook and automatically released by the locking arm when the weight of the suspended load is no longer carried by the hook; and wherein the locking arm includes a first end and a second end, wherein the locking arm includes a locking arm pivot pin formed between the first end and the second end, such that the locking arm may be pivotally coupled to the body, via the locking arm pivot pin aperture, such that the locking arm is pivotable between a closed position and an opened position, and wherein the locking arm includes a counterweight proximate the first end, wherein the counterweight is of a sufficient weight to bias the locking arm in the opened position when the weight of the suspended load is no longer carried by the hook.

2. The automatic release hook of claim 1, wherein the body, the hook, and the locking arm are each formed substantially of steel.

3. The automatic release hook of claim 1, wherein the body is generally rectangular.

4. The automatic release hook of claim 1, wherein the primary body attachment means is formed integral to the body.

5. The automatic release hook of claim 1, wherein the primary body attachment means comprises a hook, loop, or equivalent element coupled to the body.

6. The automatic release hook of claim 1, wherein the body comprises a generally inverted "U" shape having means for accepting a hook pivot pin means.

7. The automatic release hook of claim 6, wherein the hook pivot pin means comprise a separate pin attachable to the body, to allow the hook to be pivotally coupled to the body.

8. The automatic release hook of claim 1, wherein the hook pivot pin means is formed integral to the body.

9. The automatic release hook of claim 1, wherein the locking arm pivot pin aperture is formed integral to the body.

10. The automatic release hook of claim 1, wherein the locking arm pivot pin aperture comprises a collar means coupled to the body.

11. The automatic release hook of claim 1, wherein the locking arm is generally rectangular.

12. The automatic release hook of claim 1, wherein the locking arm pivot pin is formed integral to the locking arm.

13. The automatic release hook of claim 1, wherein the locking arm pivot pin comprises a pin means that may be coupled to the locking arm, to allow the locking arm to be pivotally coupled to the body.

14. The automatic release hook of claim 1, wherein the body includes an optional secondary load attachment means, such that a load may be suspended via the hook and the secondary load attachment means.

15. The automatic release hook of claim 1, wherein the secondary load attachment means is formed proximate the locking arm pivot pin aperture.

16. The automatic release hook of claim 1, wherein the secondary load attachment means is formed integral to the body.

17. The automatic release hook of claim 1, wherein the secondary load attachment means comprises a hook, loop, or equivalent element coupled to the body.

18. The automatic release hook of claim 1, wherein the locking arm includes a locking arm attachment means proximate a second end of the locking arm.

19. The automatic release hook of claim 18, wherein the locking arm attachment means is formed integral to the locking arm.

20. The automatic release hook of claim 1, wherein the locking arm attachment means comprises a hook, loop, or other equivalent element coupled to the locking arm.

* * * * *